United States Patent [19]

Richards

[11] 4,095,962

[45] Jun. 20, 1978

[54] ELECTROSTATIC SCRUBBER

[76] Inventor: Clyde N. Richards, 4887 Mission Blvd., San Diego, Calif. 92109

[21] Appl. No.: 563,689

[22] Filed: Mar. 31, 1975

[51] Int. Cl.[2] ..... B03C 3/16

[52] U.S. Cl. ..... 55/10; 55/107; 55/122; 55/136; 239/3; 239/15; 361/227

[58] Field of Search ..... 55/10, 107, 122, 123, 55/136; 239/3, 15; 317/3, 262 A, 262 E; 21/74 R; 361/227, 228

[56] References Cited

U.S. PATENT DOCUMENTS

| | | | |
|---|---|---|---|
| 1,958,406 | 5/1934 | Darrah | 55/10 X |
| 3,035,445 | 5/1962 | Evans et al. | 55/122 |
| 3,503,704 | 3/1970 | Marks | 55/107 X |
| 3,608,821 | 9/1971 | Simm | 317/3 X |
| 3,624,448 | 11/1971 | Smith et al. | 55/107 X |
| 3,681,896 | 8/1972 | Velkoff | 55/107 |
| 3,941,312 | 3/1976 | Ohno et al. | 239/15 |

FOREIGN PATENT DOCUMENTS

| | | | |
|---|---|---|---|
| 262,882 | 1/1913 | Germany | 55/107 |

OTHER PUBLICATIONS

Henricks, Jr., Charles D., et al., Photomicrography of Electrically Sprayed Heavy Particles, American Institute of Aeronautics and Astronautics (A IAA Journal), vol. 2, No. 4, Apr. 1964, pp. 733–737.

*Primary Examiner*—William A. Cuchlinski, Jr.
*Assistant Examiner*—David L. Lacey
*Attorney, Agent, or Firm*—Bruno J. Verbeck; John L. Haller

[57] ABSTRACT

Small highly charged droplets are produced without concurrent production of corona by conducting a liquid to a nozzle having a tip from which droplets of the liquid can exit, and forming a substantially uniform electric field over the surface of the liquid on the tip, the field being large enough to pull off droplets from the tip but not so large as to create corona discharge. Selected gas, solid particulates and liquid mists from gaseous effluents such as are produced by smelters, coal or oil-burning steam generators, chemical refineries and the like are removed by means of a unique electrostatic collector using the highly charged droplets. These droplets are caused to drift, by means of an electric field, through the gaseous effluent to a collecting electrode absorbing selected gases and aerosol particles and carrying them to a collecting electrode.

17 Claims, 7 Drawing Figures

ELECTROSTATIC SCRUBBER

BACKGROUND OF THE INVENTION

This invention relates to a unique method and means for producing highly charged droplets at a high rate and with low power requirements and using these droplets to remove components of a gaseous effluent. The highly charged droplets are caused to drift, by means of an electric field, through the gaseous effluent, absorbing selected gases and aerosol particles therefrom, and carrying them to a collecting electrode.

Typical of the components removable from gaseous effluents are $SO_x$ and $NO_x$.

Most of the present $SO_x/NO_x$ scrubbing systems, especially those capable of treatment of volume flow rates greater than about 2000 cfm can be classified into the following basic categories: venturi scrubbers, floating bed, packed bed, spray tower and tray column. All of these systems are characterized by one or more disadvantage, such as a high liquid-to-gas ratio, high pressure drop, scale build-up, low scrubbing efficiencies, or in requiring mist eliminators.

Thus, venturi scrubbers require the effluent to be forced through a venturi throat at velocities of 200 to 400 ft/sec. Part of the energy in the high velocity effluent flow is used to produce small droplets by tearing them off of spray nozzles which project into the flow. Initially, these gas have a high relative velocity with respect to the droplets, but the viscous drag forces rapidly accelerate the droplets to the speed of the effluent. The droplets must be subsequently removed by the use of a cyclonic precipitator, a wet electrostatic precipitator, a mist eliminator or a combination thereof. In passing through a venturi scrubbing system, the effluent undergoes a pressure drop of from 15 to 20 in. water.

For a power plant producing 1,000 MW the power required just for the compression of the effluent for such a plant would be about 5 MW or 0.5% of gross capacity. It has been determined that such systems actually require about 2.5% of gross capacity, or about 8 KW/1000 cfm.

Floating bed scrubbers suffer from scale build-up, high liquid-to-gas ratios ($\sim$50 gal/1000 cfm) and significant pressure drops ($\sim$15 in. $H_2O$). Packed bed scrubbers have similar disadvantages.

Spray towers require about 80 gal/1000 cfm representing a power loss of about 1% of the gross capacity of a power plant. Additionally, the pressure drop in a spray tower is about 10 in. water, representing another 1% real power loss of the gross capacity of the plant. Tray columns have similar disadvantages.

Most of the aforesaid scrubbing systems require the use of a mist eliminator downstream from the scrubber to remove the smaller droplets of liquor which are entrained in the gas flow, which eliminators are quite susceptible to scaling and plugging problems.

Such "mist" droplets are produced when the liquid jet from the spray nozzles breaks up. When a droplet begins to break off from the end of the jet and becomes an entity, the neck also breaks up into a much smaller, mist droplet. It is these droplets which are easily entrained in the gas flow because of their small size, and are very difficult to remove.

With my invention, all of the droplets are highly charged, thus ensuring that they will be removed in the collecting chamber. Furthermore, the energy required to produce my highly charged droplets is very small;

e.g., less than one watt is required to produce the droplets necessary for scrubbing 1000 cfm.

The large pressure drops required by conventional scrubbers is not required with my invention since the flow through the chamber is unobstructed and does not require high velocities.

A further, and important, characteristic of my invention is that the droplet sizes and drifting velocities can be controlled to ensure that saturation is achieved in all of the droplets.

Summarizing the shortcomings of previous methods for using charged particles for removing oppositely charged particles and certain gases, it has been found that one or more of the following undesirable characteristics were present:

(1) the spray nozzles used to produce the charged droplets also produced corona discharges, either from the nozzle itself or the stream of water extending from it, thus consuming power and flooding the gas with ions; (2) a significant percentage of the droplets produced were either uncharged or had such a small charge that they could not be effectively drifted by an electrical field; (3) the drop size distribution either could not be controlled or was too broad (containing very small droplets, less than 10 micron diameter, as well as large droplets, greater than 1 millimeter in diameter); (4) nozzles are used in conjunction with a venturi throat, thereby requiring large power consumption, and (5) the velocity and trajectory of the droplets, even those charged, could not be controlled, thus allowing many droplets to escape from the device.

SUMMARY OF THE INVENTION

The present invention is directed to a method and means for producing, without corona, highly charged droplets in the size range of 30 $\mu$m to 800 $\mu$m radius, every droplet being charged to substantially within an order of its maximum theoretical limit, and using an electric field, different from that used to produce and charge the droplets, to drift the droplets through a gaseous effluent to a collection electrode, the droplets absorbing one or more predetermined components from the gaseous effluent.

Stated another way, my invention is directed to a method and means wherein selected gas, solid particulates and/or liquid mists from gaseous effluents such as are produced by smelters, coal or oil-burning steam generators, chemical refineries and the like are removed effectively and economically.

Among the important advantages stemming from the use of my invention in removing predetermined components from a gaseous stream, in addition to those previously recited are, besides low power requirements, adaptability for modular construction (permitting arbitrary cleaning efficiency and high reliability), suitability for use at small effluent volume flow rates ($\sim$100 cfm) up to very large effluent flow rates ($\sim 10^6$ cfm) with a minimum of scrubbing liquor, and low initial costs.

My invention will be further illustrated in the following description and accompanying drawings, in which.

CHARGED DROPLET PRODUCTION

Figure 5:
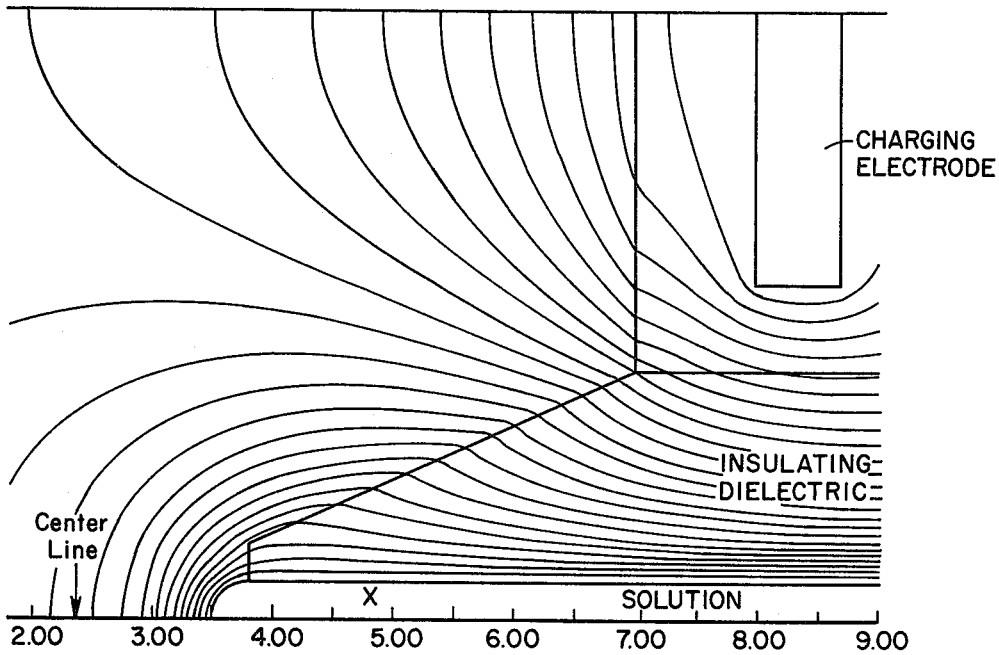
FIG. 5 is a diagramatic showing of the equipotential lines for a nozzle-charging electrode wherein the electrode is above the nozzle tip.

I have found, in accordance with my invention, that the following criteria must be satisfied if droplets are to be electrically pulled away from a nozzle tip without producing corona: (1) The field must be substantially uniform over the tip surface. (2) The field must be large at the tip surface. And (3) there must be substantial field enhancement at the tip surface. Illustrative of a configuration which works well, and in which there is a very large field enhancement near the nozzle tip, but low fields elsewhere in the region is shown in FIG. 5 in which the charging electrode is above the nozzle tip. The net electrical forces act downward on the liquid surface, away from the charging electrode, before the droplet is pulled off. As the droplet is pulled off it gains kinetic energy from the electric field, still directed away from the charging electrode. As the charged droplets move downward, they move out of the region of very high electric fields; thus their trajectories are less affected by the electric field produced by the charging electrode, allowing them to escape into the low field region below the nozzle.

The size and charge of the droplets produced can be varied by changing the voltage of the charging electrode, and this method is effective for a large range of voltages, nozzle diameters, liquid pressure head and nozzle lengths.

Figure 6:
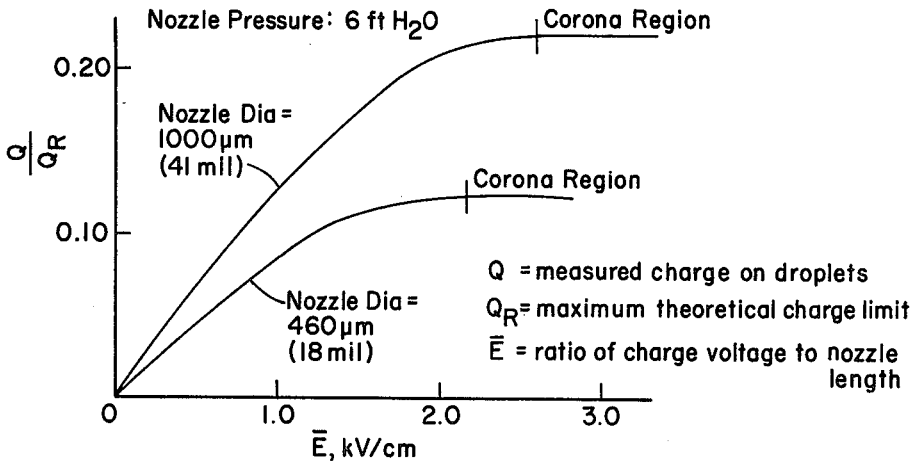
FIG. 6 is a diagramatic showing of the relationship of the ratio of the charge on the droplets to the maximum theoretical charge limit and the ratio of the charge voltage to nozzle length.
Figure 7:
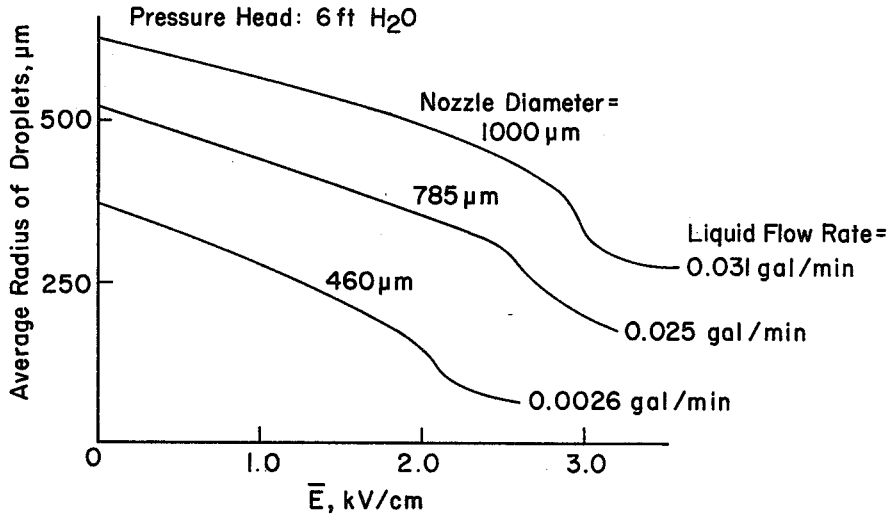
FIG. 7 is a diagramatic showing of the relationship of average radius of droplets and ratio of charge voltage to nozzle length.

The effects of various parameters are summarized in FIGS. 6 and 7.

The ratio of charging voltage (voltage applied to the charging electrode) to nozzle length (distance from nozzle tip to charging electrode) is the most important parameter for the control of the charge on the droplets. This ratio is defined as E, the average electric field in the charging region. As shown in FIG. 6, the optimum value of E is about 2.0 KV/cm. When the value is greater than this the charge on the droplets is not increased, and corona (the visible manifestation of short, brush-like electrical discharges from the jet tip into the air near the tip) occurs. It is estimated that each corona discharge will consume at least 100 times as much energy as that required to produce and charge a droplet.

Not only do the corona discharges consume large amounts of power, they flood the region with space charge which is detrimental to the scrubbing efficiency, and it is an important characterizing feature of my invention that very highly charged droplets are produced without the production of corona.

The number of droplets produced per unit time is a function of the liquid pressure head $p_1$, and E, but is relatively insensitive to the nozzle diameter. When, e.g., E is 2 KV/cm and $p_1$ is 72 in. $H_2O$, there is a maximum droplet production rate of about 1000 droplets/sec.

DRIFTING OF CHARGED DROPS

An electrostatic field is used to force the droplets to move through the gas, when the charged droplets are to scrub a gaseous effluent flow. Since the residence time of the gaseous effluent in any practical, high-volume rate scrubber is of the order of a few seconds, the droplets must be made to move through the gas in comparable but shorter periods of time.

Table 1 below shows the mobility of various sized droplets, if charged to their maximum:

TABLE 1

| r, μm | $Q_R$, Coulombs | $\nu m^2$/sec-volt | |
|---|---|---|---|
| 10 | $6.30.10^{-13}$ | $1.87.10^{-4}$ | |
| 50 | $7.09.10^{-12}$ | $4.18.10^{-4}$ | |
| 100 | $2.00.10^{-11}$ | $5.90.10^{-4}$ | |
| 150 | | | $2.9.10^{-4}$ |
| 200 | $5.67.10^{-11}$ | $8.36.10^{-4}$ | |
| 400 | $1.60.10^{-10}$ | $1.18.10^{-3}$ | |
| 500 | $2.24.10^{-10}$ | $1.32.10^{-3}$ | |
| 750 | | | $3.5.10^{-4}$ |
| 1000 | $6.30.10^{-10}$ | $1.87.10^{-3}$ | |
| 2000 | $1.79.10^{-9}$ | $2.64.10^{-3}$ | |
| | Theoretical Maxima | | Measured |

The equations used to produce Table 1 in MKS units are $$Q_R^2 = (4\pi\epsilon_o)\, 16\pi r^3\sigma \quad (1)$$

and $$\nu \equiv = \nu/E = Q_R/6\pi\eta r \quad (2)$$

where $Q_R$ is the maximum allowable charge, $r$ is the radius of the droplet, $\sigma$ is its surface tension, $\nu$ is the drift velocity of the droplet, and $\eta$ is the coefficient of viscosity of air. Equation 2 assumes that the flow is in the Reynold's regime.

The drift fields within a liquid scrubber should be maintained at less than 1 KV/cm, and preferably lower.

It is seen from the mobilities in Table 1 that a droplet must be charged to within two orders of magnitude of the maximum theoretical limit and be about 200 μm in radius if it is to have a terminal (drift) velocity as large as 1 m/sec. in a field of 1 KV/cm.

Regarding nozzle spacing, a one inch nozzle spacing has been found to be adequate, although a spacing of about two inches minimizes interaction effects. And while there may be variations in the nozzle diameter, the smallest practical diameter is about 18 mils.

DESCRIPTION OF PREFERRED EMBODIMENT

Figure 4:
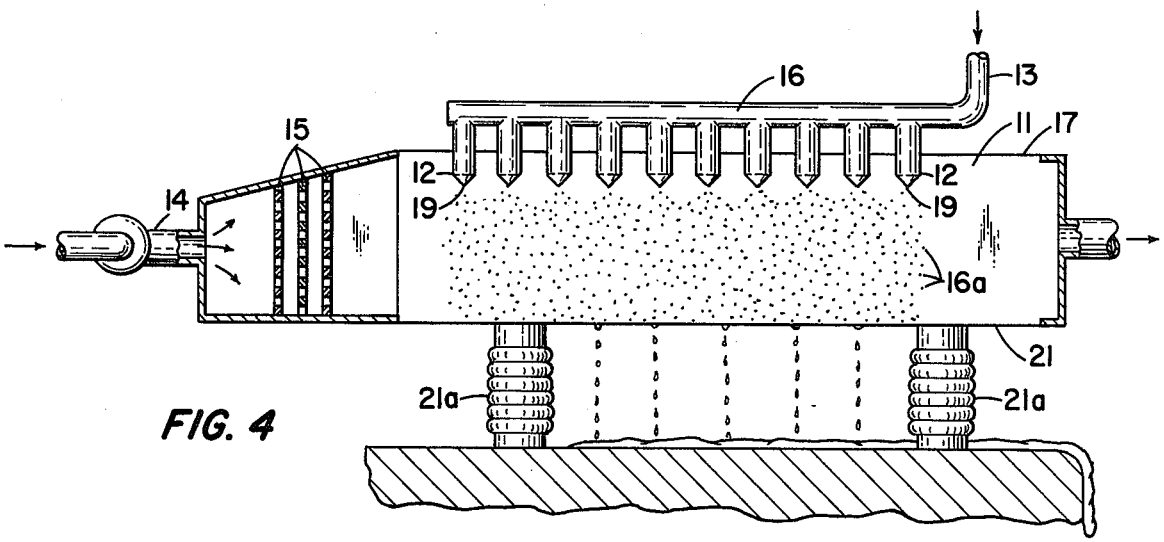
FIG. 4 is a cross-sectional diagrammatic view of an embodiment of my invention.

Referring to the drawings, an embodiment of applicant's electrostatic scrubber, or collector, comprises, as best shown in FIG. 4, a scrubbing chamber 11 substantially 96 inches long. It is trapezoidal in cross-section, 12 inches wide at the top, 16 inches wide at the bottom and 17 inches deep. The scrubbing chamber 11 is supported by electrical insulators 21*a*. A plurality, e.g. 20 of charged-droplet producing nozzles 12 project through and are suitably secured to the top of the chamber 11. A supply of scrubbing liquor, which may be a solution of ammonium hydroxide (3.5 moles per liter) when the effluent gas has an $SO_2$ concentration of, e.g., 170 ppm, is conducted through a conduit 13 to the nozzles 12.

Figure 1:
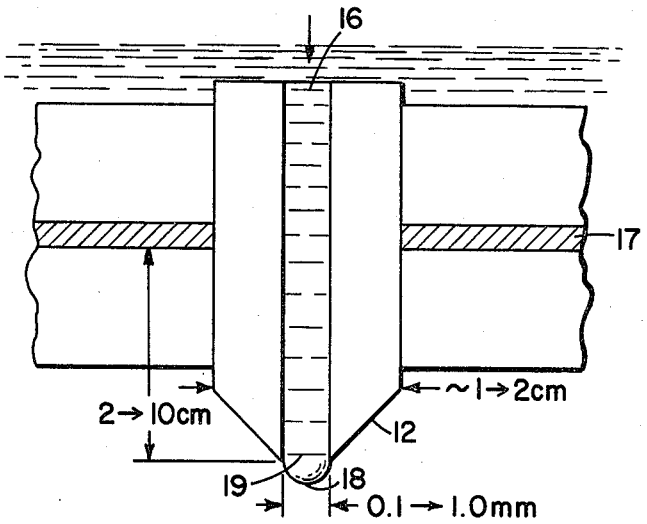
FIG. 1 is a cross-sectional fragmentary view of a nozzle used in the present invention.
Figure 2:
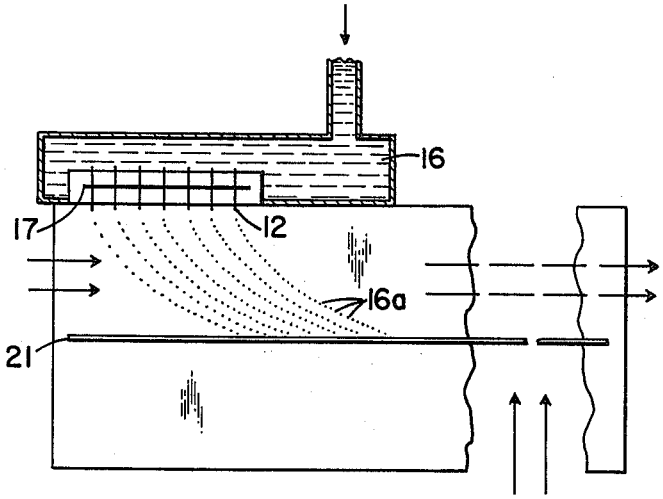
FIG. 2 is a somewhat diagrammatic view of an embodiment of my invention.

The $SO_2$-containing effluent gas which is to be scrubbed enters the chamber 11 through conduit 14, passing between baffle plates 15. Nozzles 12, a single embodiment of which is shown in FIG. 1, are, each of them formed of an electrical insulating material such as porcelain, plastic or the like, which insulates the liquor 16 from charging electrode 17 through which the nozzles 12 pass. The scrubbing liquor 16 is maintained at ground potential and the electrode 17 is raised to a high voltage $V_1$, 25 KV, by any suitable means.

Figure 3:
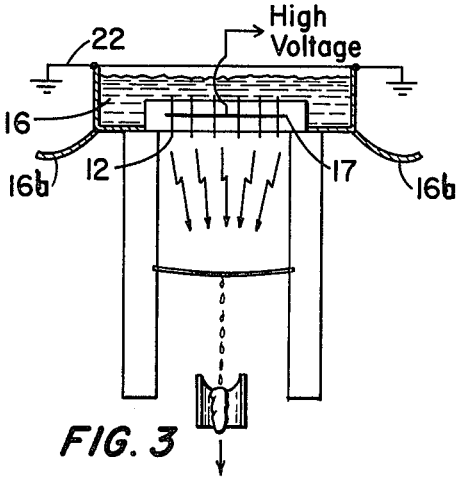
FIG. 3 is a schematic view of an embodiment of the invention showing shaping of the electrical field by means of additional grounded electrodes.

The electrode 17 is made positive if negative charged droplets are desired, and negative if positive charged droplets are desired. The configuration shown in FIG. 1 permits a very large, almost uniform electric field over the surface 18 of the liquor 16 which extends from the tip 19 of the nozzle 12. Element **16*b* of FIG. 3 is a shaped segment of the structure confining the liquid 16**.

The electric stress acts on the liquor surface 18 to oppose the surface tension stresses acting on the surface 18, and if large enough, a droplet **16*a* is pulled from the nozzle 12 and falls into the chamber 11**.

The electric stress which acts on the surface 18 is given by $$\Sigma_o E^2/2$$

where $\Sigma_o$ is the electrical permittivity of free space and E is the magnitude of the electric field at the surface 18. The surface tension stress which acts on the surface of the liquid is given by $\sigma\kappa$, where $\sigma$ is the surface tension of the liquor (=0.072 newtons/meter for $H_2O$) and $k$ is the curvature of the liquid surface 18.

Values of surface electric fields necessary to pull off droplets of various radii if the surface electric field is uniform, i.e., has the same value everywhere on the drop surface, and the surface is an hemisphere, are shown in Table II below:

Table II

| Values of Surface Electric Fields Necessary to Pull Off Droplets | |
|---|---|
| r, Meters | E, KV/cm |
| $5.10^{-6}$ | 807 |
| $10.10^{-6}$ | 571 |
| $20.10^{-6}$ | 403 |
| $40.10^{-6}$ | 285 |
| $50.10^{-6}$ | 255 |
| $75.10^{-6}$ | 208 |
| $100.10^{-6}$ | 180 |
| $200.10^{-6}$ | 128 |
| $300.10^{-6}$ | 104 |
| $400.10^{-6}$ | 90.2 |
| $500.10^{-6}$ | 80.7 |
| $10^{-3}$ | 57 |

As stated above, droplets **16*a* are produced as a result of a differential existing between the voltage of the liquor 16, held at ground potential and the electrode 17 through which the nozzle 12 passes. The voltage applied to electrode 17 does not have to be a DC voltage $V_1$, but may be an AC voltage, biased with a DC voltage so that the actual AC voltage applied to the electrode 17 is always of the same polarity. The frequency of the AC voltage may range from about 20Hz to about 50 kilo Hz. The magnitude of the voltage may be from about 5 KV to about 25 KV depending upon the length of the nozzle 12 from the tip 19 to the electrode 17**.

A collecting electrode 21 (FIG. 4) is positioned below electrode 17 and the formed droplets **16*a* are made to drift to the collecting electrode 21 by putting a voltage $V_2$ on the collecting electrode 21** by any suitable means (not shown) known in the art. The magnitude of $V_2$ will vary with different applications but should be of the same polarity as $V_1$, and will usually lie between $V_1$ and ten times $V_1$.

If desired, the electric field in the drift chamber 11 can be shaped by means of additional grounded electrodes 22 as shown in FIG. 3. These electrodes 22 help keep the charged droplets from diffusing toward the walls of the chamber 11, such diffusion being caused by each of the droplets repelling each other.

As the droplets **16*a* drift through the effluent gas which has entered, e.g., through conduit 14, they absorb selective gases ($SO_2$ in the instant example), the absorption being facilitated by making the scrubbing liquor 16** a solution in which the selective gases are quite soluble.

Table III below summarizes the results of a run using a nozzle array, scrubbing solution characteristics, effluent characteristics, voltages and scrubbing efficiency as indicated.

TABLE III

| | |
|---|---|
| Nozzle Array | |
| Number of nozzles | 20 |
| Diameter of nozzles, mil | 41 |
| Length of nozzles | 7 |
| Scrubbing Solution | |
| Solute | $NH_4OH$ |
| Molarity, moles/liter | 3.5 |
| Solution Flow Rate, gal/min | 0.5 |
| Solute Flow Rate, moles/min | 6.7 |
| Effluent | |
| Volume Flow Rate, cfm | 260 |
| $SO_2$ Concentration, ppm | 170 |
| $SO_2$ Flow Rate, moles/min | 0.06 |
| Voltages | |
| Charging, KV | 20 |
| Drift, KV | 30 |
| Scrubbing | |
| Efficiency | 99 |

The absorption of particulate matter is more efficient if the particles have been charged upstream with a polarity opposite to that of the droplets **16*a***. Thus, most small particulates, <5 micrometers, which escape from conventional electrostatic precipitators will carry a small net negative charge (~100 electrons), therefore positively charged droplets would be produced to obtain coulomb-enhanced coalescence of the particles and the droplets.

It is one advantage of my invention that the droplet size can be controlled over the range of 20 micrometers diameter to 2mm diameter by suitably varying the size of the nozzle opening, the applied voltages $V_1$ and $V_2$ and the pressure head of the scrubbing liquor.

Each droplet is highly charged ($10^{-11} \rightarrow 10^{-9}$ coulomb), approaching the maximum limit given by $Q^2 = (4\pi\epsilon_o)\ 16\ \pi r^3\sigma$ where $r$ is the radius of the droplet, $\sigma$ is the surface tension of the droplet and Q is the maximum charge which can be placed on the droplet before it will self-divide.

A high charge ensures not only that the droplet can be easily drifted by an electric field, but also that oppositely charged ions and particles will be collected by the droplets.

The number of droplets produced per unit of time per nozzle can be controlled by the voltage $V_1$ and the pressure head of the scrubbing liquor.

The use of two independent electric fields, caused by $V_1$ and $V_2$ allows for a variable drift velocity (0 - 30 m/sec.) of the droplets after they are produced and allows for optimation of coalescence efficiency due to the presence of the drift field.

Production of small droplets (~100 micrometers) produces a large surface to volume ratio of the scrubbing liquor, thereby allowing scrubbing of large volumes of effluent gas with small amounts of scrubbing liquor.

An additional advantage lies in that the power requirements are quite small (<1 kW) since (a) there is virtually no pressure drop of the effluent gas as it passes through the scrubber, (b) the total electric current due to the movement of the charged droplets will be of the order of a few milliamperes, probably not exceeding 100 milliamperes for the largest application ($\sim 10^6$ cfm) and (c) there are no power-consuming corona discharges.

The electric field used to drift the droplets through the gaseous effluent is preferably perpendicular to and essentially uniform throughout the effluent flow, so that each of the droplets has a constant force driving it to the collection electrode.

With my invention the power requirements per unit effluent volume flow rate are a fraction of that for present scrubbers, and extremely high scrubbing efficiencies can be obtained with power requirements and liquid-to-gas ratios substantially less than those used in present day scrubber or precipitator systems.

Finally, the reliability of my novel scrubber and method, as well as scrubbing efficiency can be tailored within initial and operating cost restraints, since. e.g., several independent nozzle arrays can be arranged in series, anyone of which can be removed from service or repair while the system remains operative.

Among the uses of my invention are, for example, scrubbing $SO_x$ and $NO_x$ from power generation plants, and other industrial gaseous effluents; removal of small particulates (<20 micrometers) from such gaseous effluents as fly ash, carbon smoke particles and the like; removal of chemical mist particles from gaseous effluents; and scrubbing various gases containing organic molecules from gaseous effluents.

What is claimed is:

1. A method for producing highly charged droplets without effecting corona discharge which comprises:

(a) conducting a liquid to be formed into said highly charged droplets to a nozzle having a tip from which said liquid protrudes; and (b) forming a substantially uniform electric field over the surface of said liquid protruding from said tip, said electric field being sufficiently large to pull said highly charged droplet free of said tip without creating corona discharge.

2. The method of claim 1 wherein the liquid is at ground potential when it enters the nozzle.

3. The method of claim 1 wherein said electric field is formed by applying a first voltage to said liquid and a second voltage to a charging electrode.

4. The method of claim 3 wherein a D.C. voltage is applied to said electrode.

5. The method of claim 3 wherein AC voltage is applied to said electrode, and said AC voltage is biased with a DC voltage so that the actual AC voltage applied to the electrode maintains the same polarity.

6. The method of claim 5 wherein the frequency of said AC voltage is from about 20 $H_z$ to about 50 kilo $H_z$.

7. The method of claim 5 wherein the magnitude of said voltage is from about 5 KV to about 25 KV.

8. The method of claim 3 wherein the ratio of the difference in voltages between said charging electrode and said liquid to the distance from said nozzle tip to said charging electrode is about 2.0 KV/cm.

9. The method of claim 1 wherein the diameter of said droplets is from about 20 micro meters to about 2 millimeters.

10. The method of claim 1 wherein the charge on said droplets is about $10^{-11}$ to about $10^{-9}$ coulombs.

11. The method of claim 1 wherein the number of droplets produced per unit of time per nozzle is controlled by varying the strength of said electric field and the pressure head on said liquid.

12. The method of claim 1 wherein the diameter of the droplets is about 100 micro meters.

13. An improved method for removing one or more predetermined components from a gaseous stream, of the type wherein a scrubbing liquid is formed into highly charged droplets, the droplets are conducted into a chamber, a gaseous stream containing said predetermined components is passed through said chamber into contact with said droplets whereby said droplets remove said predetermined components from said gaseous stream and the charged droplets are then collected on a collecting electrode which has an electrical charge opposite that of said droplets, the improvement comprising:

(a) conducting said scrubbing liquid to a nozzle having a tip from which said liquid protrudes; and (b) forming a substantially uniform electric field over the surface of the liquid as it protrudes from said tip, said electric field being sufficiently large to pull said highly charged droplets free of said tip without creating corona discharge.

14. The improvement set forth in claim 13 wherein the diameter of said droplets is from about 20 micro meters to about 2 millimeters.

15. The improvement set forth in claim 13 wherein the charge on said droplets is about $10^{-11}$ to about $10^{-9}$ coulombs.

16. The method of claim 13 wherein said electric field is formed by applying a first voltage to said liquid and a second voltage to a charging electrode.

17. The method of claim 16 wherein the ratio of the difference in voltages between said charging electrode and said liquid to the distance from said nozzle tip to said charging electrode is about 2.0 KV/cm.

* * * * *